US009726185B2

(12) United States Patent
Chen et al.

(10) Patent No.: US 9,726,185 B2
(45) Date of Patent: Aug. 8, 2017

(54) CENTRIFUGAL COMPRESSOR WITH CASING TREATMENT FOR SURGE CONTROL

(71) Applicant: Honeywell International Inc., Morristown, NJ (US)

(72) Inventors: Hua Chen, Shanghai (CN); Vai Man Lei, Torrance, CA (US); Mike Gu, Shanghai (CN); Catherine Yao, Shanghai (CN); Jeff Duan, Shanghai (CN)

(73) Assignee: Honeywell International Inc., Morris Plains, NJ (US)

( * ) Notice: Subject to any disclaimer, the term of this patent is extended or adjusted under 35 U.S.C. 154(b) by 1078 days.

(21) Appl. No.: 13/893,675

(22) Filed: May 14, 2013

(65) Prior Publication Data

US 2014/0341727 A1 Nov. 20, 2014

(51) Int. Cl.
*F04D 17/10* (2006.01)
*F04D 25/02* (2006.01)
(Continued)

(52) U.S. Cl.
CPC ..... *F04D 17/10* (2013.01); *F04D 25/024* (2013.01); *F04D 29/4213* (2013.01); *F04D 29/685* (2013.01); *F05D 2220/40* (2013.01)

(58) Field of Classification Search
CPC ..... F04D 29/685; F04D 29/4213; F04D 27/0207; F04D 27/0215; F04D 27/0238; F04D 17/10; F04D 25/024; F05D 2220/40
See application file for complete search history.

(56) References Cited

U.S. PATENT DOCUMENTS 2,656,096 A 10/1953 Schwarz
4,155,684 A 5/1979 Curiel et al.
(Continued)

FOREIGN PATENT DOCUMENTS

DE 102 23 876 A1 12/2003
EP 0 526 965 A2 2/1993
(Continued)

OTHER PUBLICATIONS

EP Search Report for EP Application No. 14165913.6 dated Oct. 15, 2014.
(Continued)

*Primary Examiner* — Dwayne J White
*Assistant Examiner* — Adam W Brown
(74) *Attorney, Agent, or Firm* — John C. James

(57) ABSTRACT

A centrifugal compressor for compressing a fluid comprises a compressor wheel having a plurality of circumferentially spaced blades, and a compressor housing in which the compressor wheel is mounted. The compressor housing includes an inlet duct through which the fluid enters in an axial direction and is led by the inlet duct into the compressor wheel, and a wheel shroud located radially adjacent the tips of the blades. The wheel shroud has a port for bleeding off a portion of air flowing through the compressor. The bleed air enters an annular space, flows forward, and is injected back into the inlet flow through a plurality of circumferentially spaced slots defined through the wheel shroud. The slots are open at a leading edge of the wheel shroud.

8 Claims, 6 Drawing Sheets

(51) Int. Cl.
*F04D 29/42* (2006.01)
*F04D 29/68* (2006.01)

(56) References Cited

U.S. PATENT DOCUMENTS

| | | | | |
|---|---|---|---|---|
| 4,375,937 | A | 3/1983 | Cooper | |
| 4,930,978 | A | 6/1990 | Khanna et al. | |
| 4,981,018 | A | 1/1991 | Jones et al. | |
| 4,990,053 | A | 2/1991 | Rohne | |
| 5,246,335 | A | 9/1993 | Mitsubori et al. | |
| 5,282,718 | A | 2/1994 | Koff et al. | |
| 5,295,785 | A | 3/1994 | Church et al. | |
| 5,304,033 | A | 4/1994 | Tang | |
| 5,308,225 | A | 5/1994 | Koff et al. | |
| 5,863,178 | A | 1/1999 | Scheinert et al. | |
| 6,062,028 | A | 5/2000 | Arnold et al. | |
| 6,324,848 | B1 | 12/2001 | Gladden et al. | |
| 6,345,503 | B1 | 2/2002 | Gladden | |
| 6,447,241 | B2 | 9/2002 | Nakao | |
| 6,517,309 | B1 | 2/2003 | Zaher | |
| 6,672,062 | B2 | 1/2004 | Shaffer | |
| 6,726,441 | B2 | 4/2004 | Sumser et al. | |
| 6,792,755 | B2 | 9/2004 | Arnold | |
| 6,834,501 | B1 | 12/2004 | Vrbas et al. | |
| 7,229,243 | B2 | 6/2007 | Nikpour et al. | |
| 7,407,364 | B2 | 8/2008 | Arnold et al. | |
| 7,775,759 | B2 | 8/2010 | Sirakov et al. | |
| 8,272,832 | B2 | 9/2012 | Yin | |
| 8,888,440 | B2 * | 11/2014 | Tomita | F04D 29/4213 415/57.1 |
| 2002/0192073 | A1 | 12/2002 | Japikse | |
| 2007/0271921 | A1 | 11/2007 | Chen | |
| 2009/0013689 | A1 | 1/2009 | Sumser et al. | |

FOREIGN PATENT DOCUMENTS

| | | | | |
|---|---|---|---|---|
| EP | 1 143 149 | A2 | 10/2001 | |
| EP | 2434165 | A1 | 3/2012 | |
| GB | 897 575 | | 5/1962 | |
| GB | 2 202 585 | A | 9/1988 | |
| JP | H9-310699 | A | 12/1997 | |
| JP | 2003-314496 | A | 11/2003 | |
| WO | WO 01/18404 | A1 | 3/2001 | |
| WO | WO 2005/121560 | A1 | 12/2005 | |
| WO | WO 2006/060732 | A1 | 6/2006 | |
| WO | WO 2007/093367 | | 8/2007 | |
| WO | WO 2011045975 | A1 * | 4/2011 | F04D 29/4213 |

OTHER PUBLICATIONS

European Search Report for Application No. EP 09 15 7220 dated Jul. 9, 2009.
International Search Report for Application No. PCT/US03/41626 dated Sep. 15, 2004.
International Search Report for Application No. PCT/US2004/017866 dated Oct. 7, 2004.
International Search Report for Application No. PCT/US2006/006867 dated Jul. 25, 2006.

* cited by examiner

CENTRIFUGAL COMPRESSOR WITH CASING TREATMENT FOR SURGE CONTROL

BACKGROUND OF THE INVENTION

The present disclosure relates to centrifugal compressors used for compressing a fluid such as air, and more particularly relates to centrifugal compressors and methods in which surge of the compressor is controlled by bleeding off a portion of the at least partially compressed fluid and recirculating the portion to the inlet of the compressor.

Centrifugal compressors are used in a variety of applications for compressing fluids. A single-stage centrifugal compressor can achieve peak pressure ratios above 4.0 and is much more compact in size than an axial flow compressor of equivalent pressure ratio. Accordingly, centrifugal compressors are commonly used in turbochargers for boosting the performance of gasoline and diesel engines for vehicles.

In turbocharger applications, it is important for the compressor to have a wide operating envelope, as measured between the "choke line" at which the mass flow rate through the compressor reaches a maximum possible value because of sonic flow conditions in the compressor blade passages, and the "surge line" at which the compressor begins to surge. Compressor surge is a compression system instability associated with flow oscillations through the whole compressor system. It is usually initiated by aerodynamic stall or flow separation in one or more of the compressor components as a result of exceeding the limiting flow incidence angle to the compressor blades or exceeding the limiting flow passage loading.

Surge causes a significant loss in performance and thus is highly undesirable. In some cases, compressor surge can also result in damage to the engine or its intake pipe system.

Thus, there exists a need for an improved apparatus and method for providing compressed fluid, such as in a turbocharger, while reducing the occurrence of compressor surge. In some cases, the prevention of compressor surge can expand the useful operating range of the compressor.

BRIEF SUMMARY OF THE DISCLOSURE

The present disclosure is directed to a centrifugal compressor having a fluid recirculation system aimed at controlling surge. In accordance with one embodiment disclosed herein, a centrifugal compressor for a turbocharger for compressing air to be delivered to an engine air intake comprises a compressor wheel having a hub defining a rotational axis and having a plurality of circumferentially spaced blades each joined to the hub and extending generally radially outwardly to a blade tip, each of the blades having a leading edge and a trailing edge spaced downstream from the leading edge along a flow direction of a main flow of air through the wheel. The compressor includes a compressor housing in which the compressor wheel is mounted so as to be rotatable about the rotational axis of the compressor wheel, the compressor housing including an inlet duct through which air enters in a direction generally parallel to the rotational axis of the compressor wheel and is led by the inlet duct into the compressor wheel. A wheel shroud is defined by the compressor housing. The wheel shroud is located radially adjacent the blade tips and extends upstream from the blades with respect to the main flow proceeding along the flow direction, and terminates at a leading edge of the wheel shroud spaced axially upstream of the blade leading edges. The wheel shroud has a radially inner surface wetted by the main flow and has a radially outer surface spaced radially inward of an inner surface of the inlet duct, such that an annular space is defined between the radially outer surface of the wheel shroud and the inner surface of the inlet duct;

The wheel shroud proximate the blade tips defines a port that extends generally radially outwardly from the radially inner surface to the radially outer surface of the wheel shroud, into the annular space. A plurality of circumferentially spaced slots are formed in the wheel shroud, each slot extending through the leading edge of the wheel shroud such that the slot is open at the leading edge of the wheel shroud. The slots extend axially downstream to a position axially spaced upstream from the port in the wheel shroud. Each slot over an entire length thereof extends from the radially inner surface to the radially outer surface of the wheel shroud. Accordingly, a portion of air passing through the compressor wheel can flow out through the port into the annular space, then upstream within the annular space, and finally inwardly through the slots so as to be injected, as recirculated air, back into the main flow.

In certain embodiments, each of the shroud portions that extend circumferentially between each slot and a neighboring slot, at the radially outer surface of the wheel shroud, has a greater circumferential extent than does each of the slots. In other words, the slots are relatively narrow in the circumferential direction.

In some embodiments as described herein, the slots are angled with respect to a radial direction, in an opposite sense relative to a rotation direction of the compressor wheel, such that the recirculated air is injected back into the main flow with a counter-swirl. Alternatively, the slots can be oriented substantially radially so as to inject the recirculated air into the main flow with substantially no swirl component. Still another alternative is to angle the slots in the same sense as the rotation direction of the compressor wheel, thereby imparting pre-swirl to the injected fluid.

In other embodiments, the compressor also includes an annular flow-guiding member that extends from the inlet duct radially inwardly and axially downstream to a trailing edge of the flow-guiding member. This trailing edge is proximate the leading edge of the wheel shroud. The flow-guiding member serves to substantially prevent the main flow of air from passing through the slots while allowing the recirculated air to pass through the slots. The trailing edge of the flow-guiding member can be axially spaced from the leading edge of the wheel shroud, such that there is a 360° gap between the trailing edge of the flow-guiding member and the leading edge of the wheel shroud.

In some embodiments, there are at least eight of the slots, distributed over 360° about the wheel shroud.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
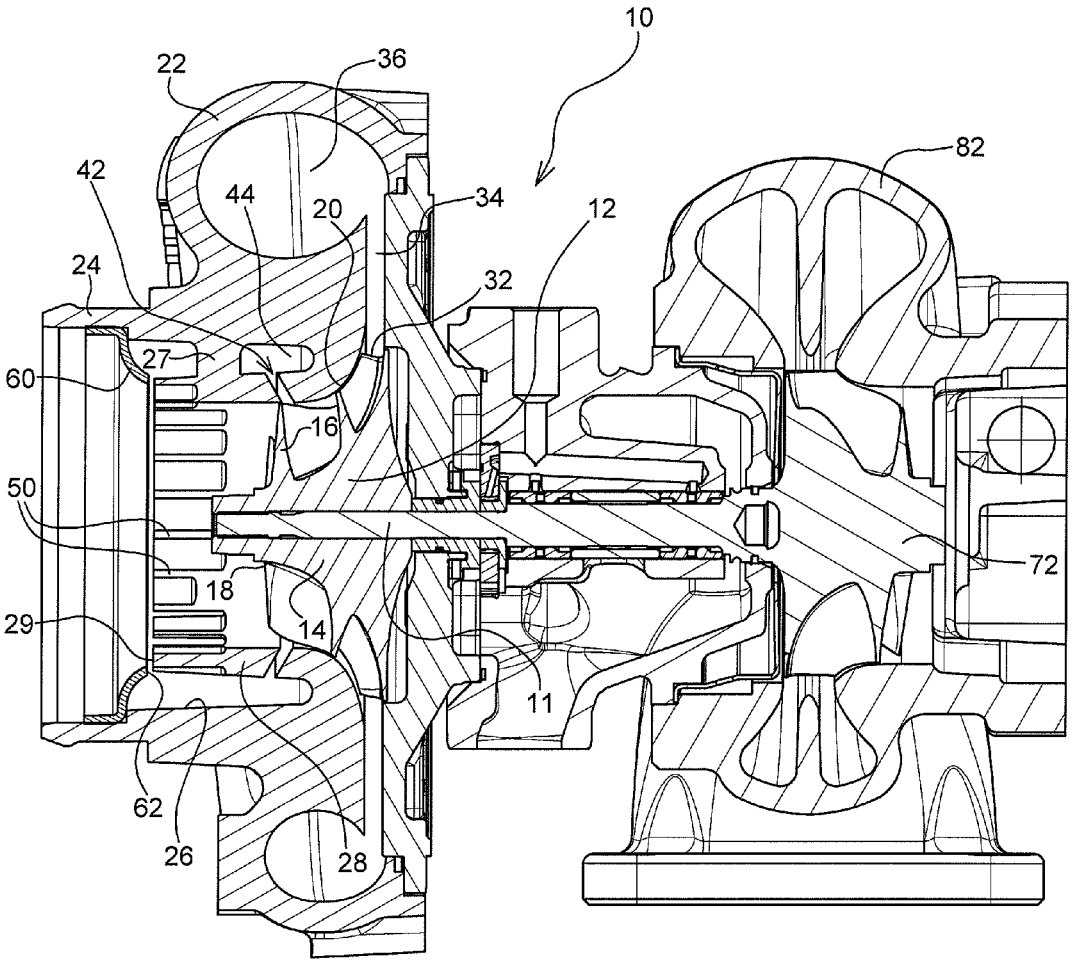
FIG. 1 is an axial cross-sectional view of a turbocharger in accordance with one embodiment of the invention.
Figure 1A:
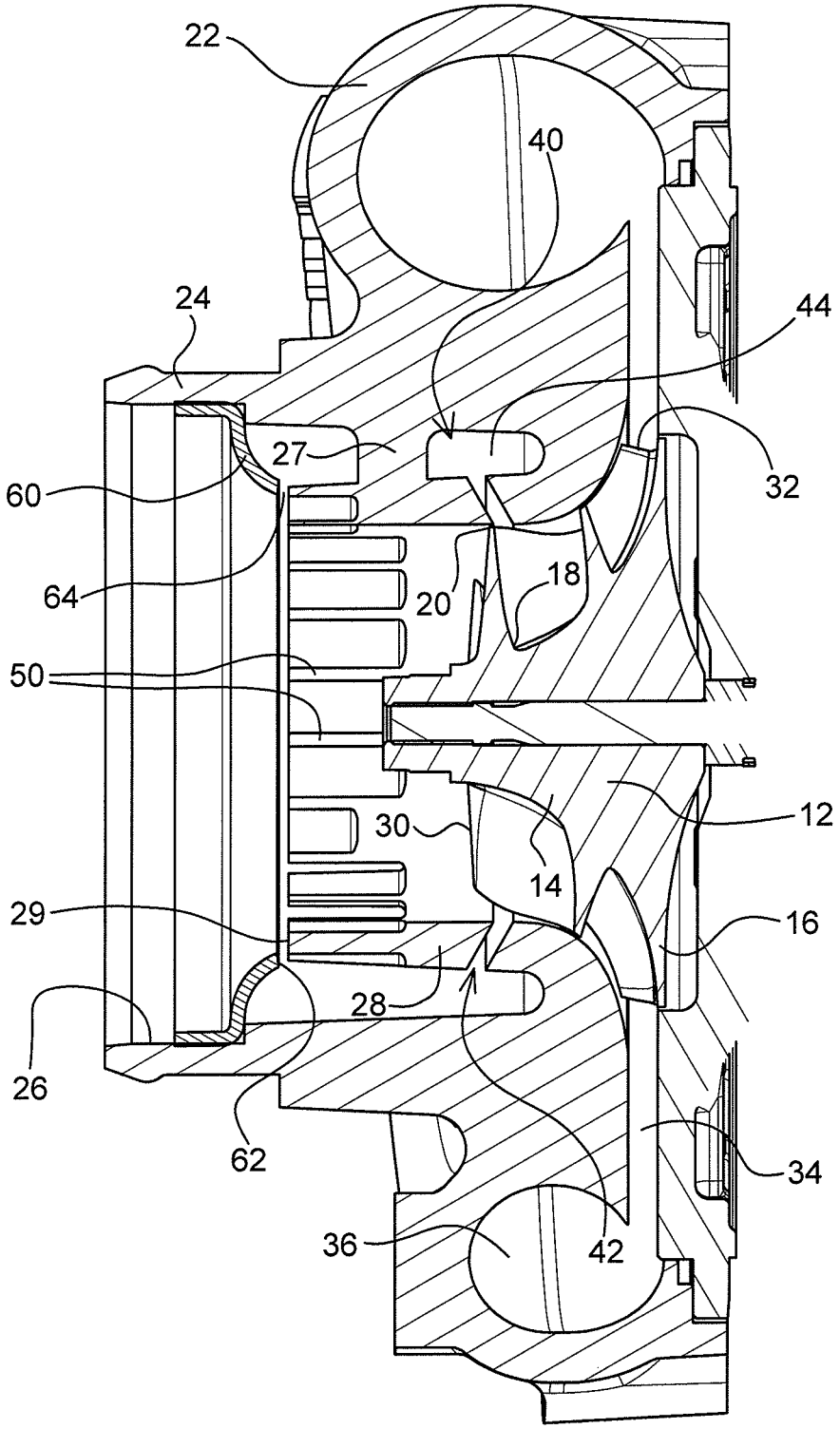
FIG. 1A is an axial cross-sectional view of the compressor portion of the turbocharger of FIG. 1.
Figure 2:
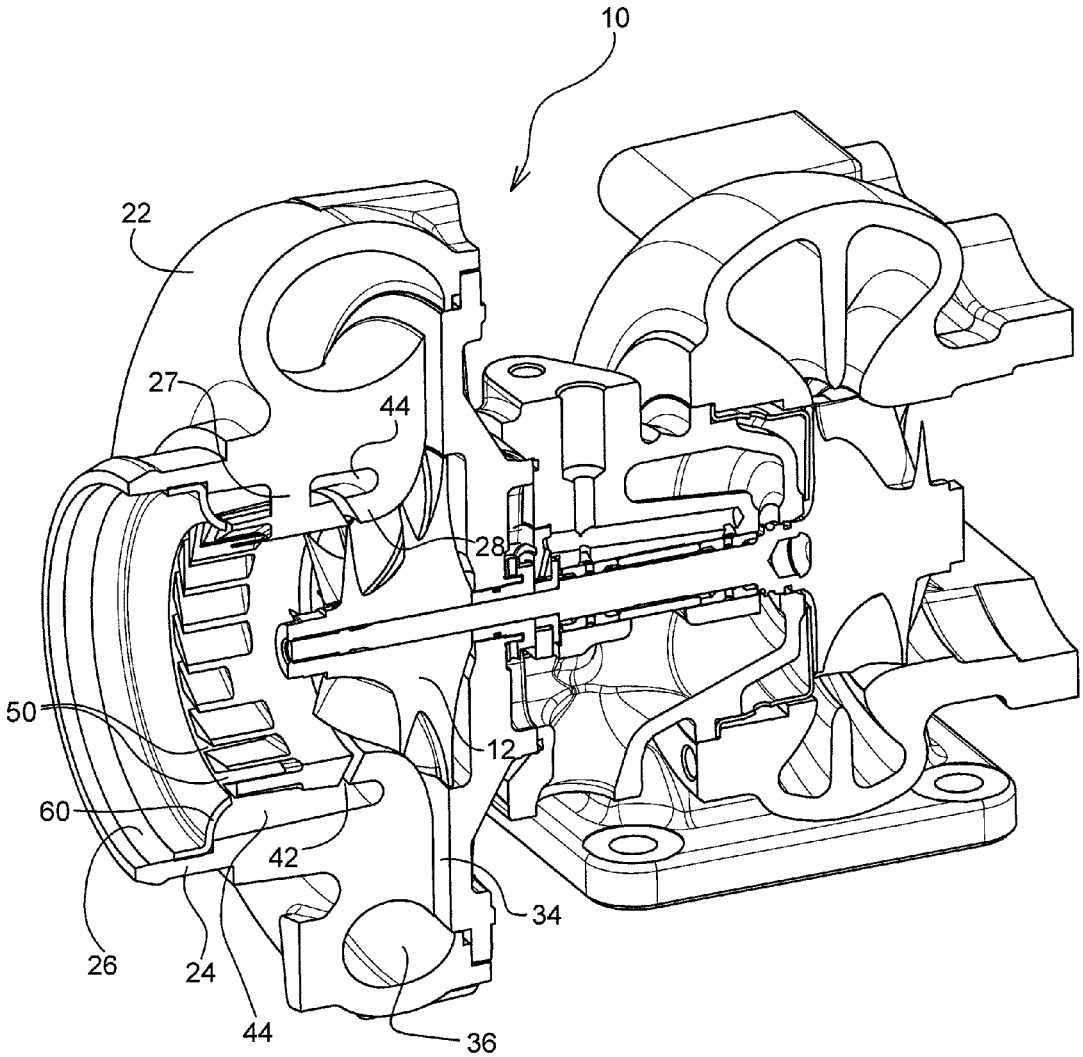
FIG. 2 is an axially sectioned perspective view of the turbocharger of FIG. 1.

A turbocharger 10 in accordance with one embodiment of the invention is depicted in FIGS. 1 and 2, and FIG. 1A depicts the compressor portion of the turbocharger. The turbocharger comprises a compressor wheel 12 mounted within a compressor housing 22 and having a hub 14 and a plurality of circumferentially spaced blades 16 joined to the hub and extending generally radially outwardly therefrom. Each blade has a root 18 attached to the hub and an opposite tip 20. The compressor wheel 12 is connected to a shaft 11 that is rotatable about a rotational axis and is driven by a turbine wheel 72 affixed to the opposite end of the shaft 11 and mounted within a turbine housing 82. The compressor housing 22 includes an inlet duct 24 formed by a duct wall 26 that encircles the axis. The compressor housing further includes a wheel shroud 28 that is radially adjacent the tips 20 of the compressor blades and, together with the hub 14 of the compressor wheel, defines a flowpath for fluid to flow through the blade passages of the compressor wheel. The inlet duct 24 is configured such that the fluid flow approaches the leading edges 30 of the compressor blades 16 in a direction substantially parallel to the rotational axis. The flowpath defined by the hub and wheel shroud is configured to turn the fluid flow radially outwardly as the fluid flows through the blade passages. The fluid exits the blade passages at the blade trailing edges 32 in a generally radially outward direction (although also having a swirl or circumferential component of velocity) and passes through a diffuser passage 34 into a discharge volute 36 that comprises a generally toroidal or annular chamber surrounding the compressor wheel.

Figure 3:
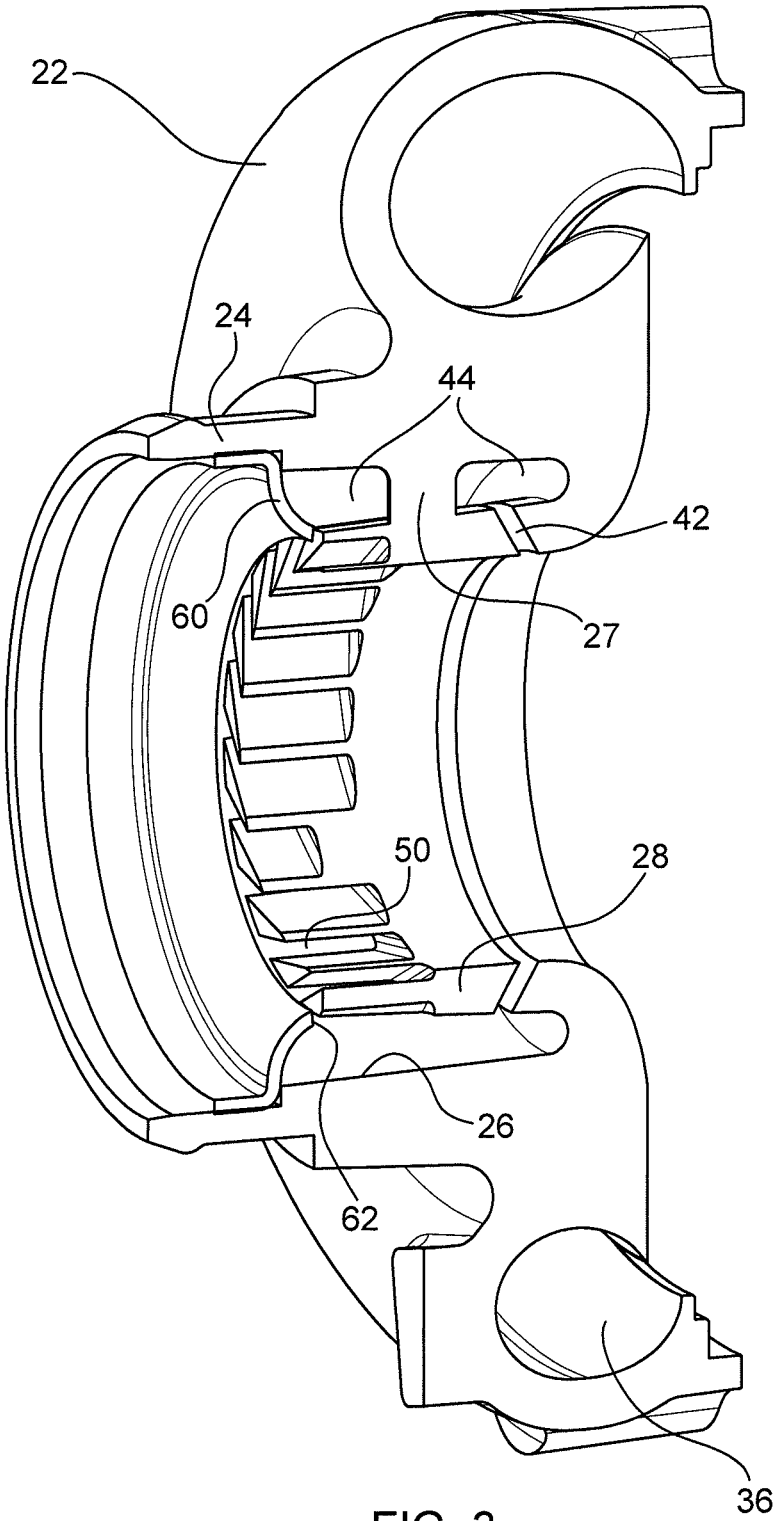
FIG. 3 is an axially sectioned perspective view of a compressor housing assembly for the turbocharger of FIG. 1.

With particular reference to FIGS. 1A and 3, the compressor further includes a bleed flow recirculation system 40 for controlling surge of the compressor. The recirculation system includes a bleed port 42 defined in the wheel shroud 28 at a location intermediate the leading edges 30 and trailing edges 32 of the compressor blades. The bleed port in one embodiment is a substantially uninterrupted full 360° annular port that encircles the tips of the compressor blades. At a given compressor speed when compressor discharge pressure is increased or when compressor mass flow is reduced, a portion of the fluid flowing through the blade passages is bled off through the bleed port 42. This bleed portion is partially compressed and thus at a higher total pressure than the fluid entering the compressor inlet duct 24. The bleed portion also has a circumferential or swirl component of velocity because of the action of the rotating compressor blades.

The bleed port 42 is connected to a passage 44 defined in the compressor housing 22. More specifically, the passage 44 is defined between a radially outer surface of the wheel shroud 28 and a radially inner surface of the duct wall 26. In one embodiment, the passage 44 comprises a substantially uninterrupted full 360° annular passage, except for the presence of a relatively small number of support struts 27 that extend between the duct wall 26 and the wheel shroud 28 as further described below. The passage 44 extends in a generally axial direction opposite to the direction of the main fluid flow in the inlet duct 24, to a point spaced upstream (with respect to the main fluid flow) of the compressor blade leading edges.

The wheel shroud 28 extends upstream from the blades 16 with respect to the main flow proceeding along the flow direction and terminates at a leading edge 29 of the wheel shroud spaced axially upstream of the blade leading edges 30. The wheel shroud defines a plurality of circumferentially spaced slots 50 in the wheel shroud, forming part of the recirculation system 40. Each slot extends through the leading edge 29 of the wheel shroud such that the slot is open at the leading edge of the wheel shroud, and extends axially downstream to a position axially spaced from the port 42 in the wheel shroud. Each slot over its entire length extends from the radially inner surface to the radially outer surface of the wheel shroud 28. The wheel shroud defines a shroud portion extending circumferentially between each slot and a neighboring slot. Each shroud portion, at the radially outer surface of the wheel shroud, can have a greater circumferential extent than each slot.

A portion of the air passing through the compressor wheel 12 can flow out through the port 42 into the annular space 44, then upstream within the annular space, and finally inwardly through the slots 50 so as to be injected, as recirculated air, back into the main flow approaching the compressor wheel. This recirculation of air serves to help control surge of the compressor.

The slots 50 in some embodiments are angled with respect to a radial direction, in an opposite sense relative to a rotation direction of the compressor wheel 12, such that the recirculated air is injected back into the main flow with a counter-swirl. Thus, in FIG. 2, the slots 50 as shown will inject the recirculated air with a swirl component of velocity that is counterclockwise, while the compressor wheel 12 rotates clockwise. Alternatively, in other embodiments, the slots can be oriented substantially radially to inject the air with no swirl component, or can be angled in the same sense as the wheel rotation so as to inject the air with pre-swirl.

The number of the slots 50 can vary depending on the particular application. In some embodiments, there are at least eight slots. The spacing of the slots circumferentially can be uniform or asymmetric (non-uniform). Asymmetrically spaced slots can be used to overcome the non-uniform flow condition at the port 42 caused by the housing 22, and thereby make the flow bleeding system 40 more effective.

In the embodiment of FIGS. 1, 1A, 2, and 3, the compressor further includes a flow-guiding member 60. The flow-guiding member is an annular member that extends from the inlet duct 24 radially inwardly and axially downstream to a trailing edge 62 of the flow-guiding member. The trailing edge 62 is proximate the leading edge 29 of the wheel shroud 28, advantageously axially spaced therefrom, such that there is a 360° gap 64 between the trailing edge of the flow-guiding member and the leading edge of the wheel shroud. The flow-guiding member serves to substantially prevent the main flow of air from passing radially inwardly through the slots 50 while allowing the recirculated air to pass through the slots. The flow-guiding member also helps to direct the recirculated air through the slots.

Figure 4:
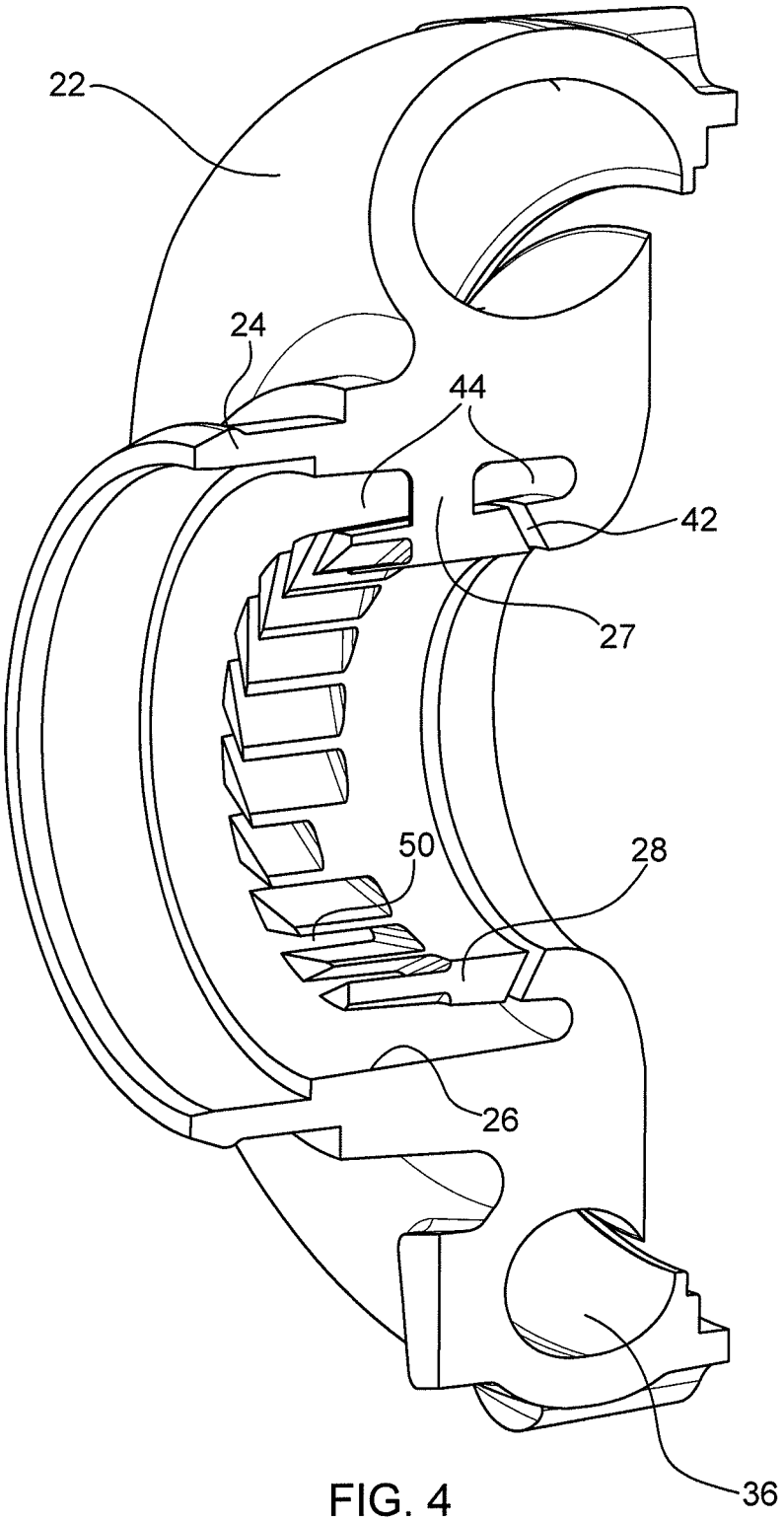
FIG. 4 is a view similar to FIG. 3, showing an alternative embodiment in accordance with the invention.
Figure 5:
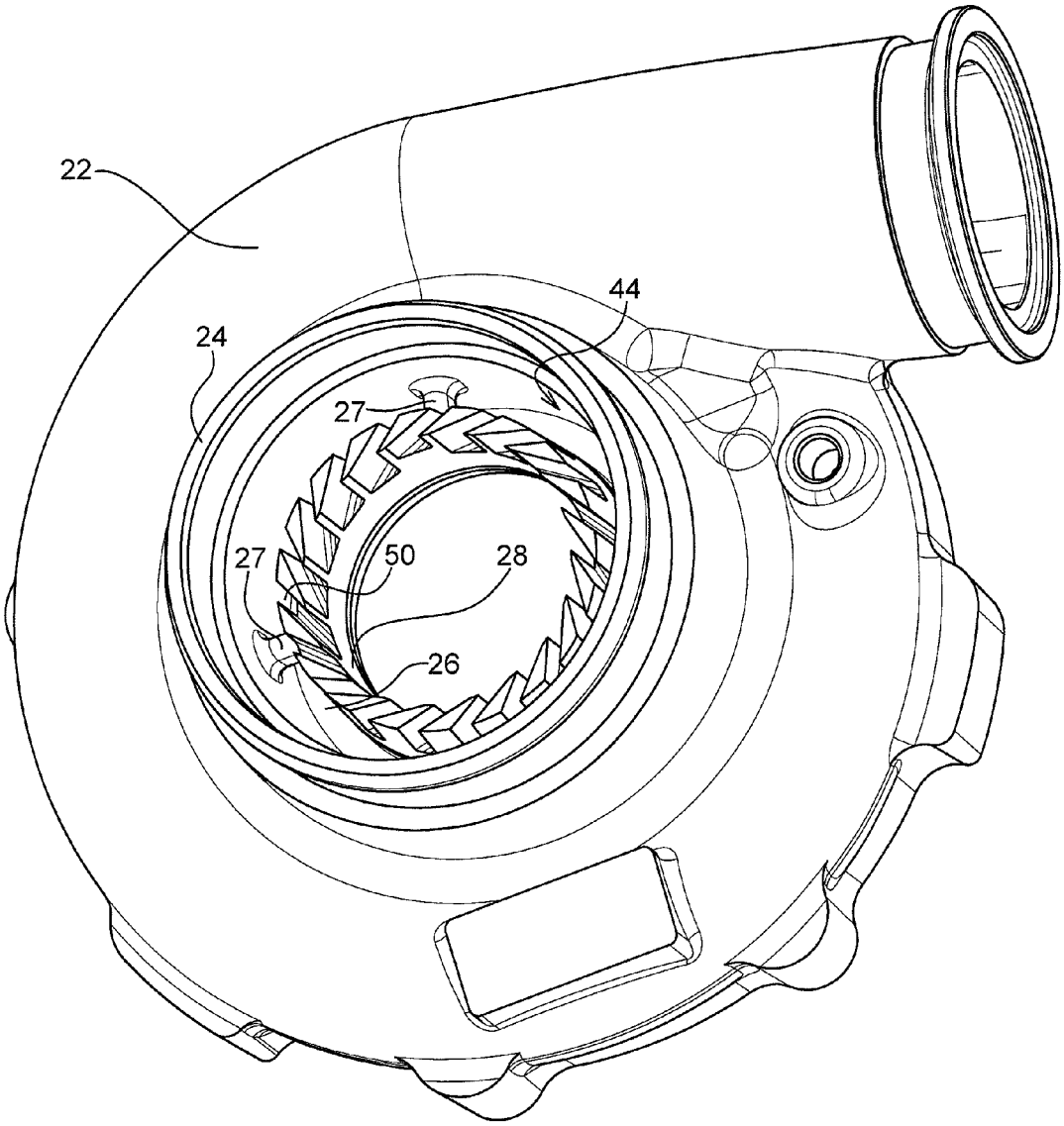
FIG. 5 is a perspective view of the compressor housing assembly of FIG. 4.

In other embodiments, such as the one depicted in FIGS. 4 and 5, the compressor does not include the flow-guiding member. In other respects, the embodiment of FIGS. 4 and 5 is substantially identical to that of FIGS. 1 through 3.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A centrifugal compressor for a turbocharger for compressing air to be delivered to an engine air intake, comprising:

a compressor wheel having a hub defining a rotational axis and having a plurality of circumferentially spaced blades each joined to the hub and extending generally radially outwardly to a blade tip, each of the blades having a leading edge and a trailing edge spaced downstream from the leading edge along a flow direction of a main flow of air through the wheel;

a compressor housing in which the compressor wheel is mounted so as to be rotatable about the rotational axis of the compressor wheel, the compressor housing including an inlet duct through which a main flow of air enters in a flow direction generally parallel to the rotational axis of the compressor wheel and is led by the inlet duct into the compressor wheel;

a wheel shroud located radially adjacent the blade tips, the wheel shroud extending upstream from the blades with respect to the main flow proceeding along the flow direction and terminating at a leading edge of the wheel shroud spaced axially upstream of the blade leading edges, the wheel shroud having a radially inner surface wetted by the main flow and having a radially outer surface spaced radially inward of an inner surface of the inlet duct such that an annular space is defined between the radially outer surface of the wheel shroud and the inner surface of the inlet duct;

the wheel shroud defining a port proximate the blade tips and extending generally radially outwardly from the radially inner surface to the radially outer surface of the wheel shroud, into the annular space;

a plurality of circumferentially spaced slots formed in the wheel shroud, each slot extending through the leading edge of the wheel shroud such that the slot is open at the leading edge of the wheel shroud, and extending axially downstream to a position axially spaced from the port in the wheel shroud, and each slot over an entire length thereof extending from the radially inner surface to the radially outer surface of the wheel shroud, such that a portion of air passing through the compressor wheel can flow out through the port into the annular space, then upstream within the annular space, and finally inwardly through the slots so as to be injected, as recirculated air, back into the main flow; and an annular flow-guiding member that extends from the inlet duct radially inwardly and axially downstream to a trailing edge of the flow-guiding member, said trailing edge being proximate the leading edge of the wheel shroud, the flow-guiding member serving to substantially prevent the main flow of air from passing through the slots while allowing the recirculated air to pass through the slots, wherein the trailing edge of the flow-guiding member is axially spaced from the leading edge of the wheel shroud, such that there is a 360-degree gap between the trailing edge of the flow-guiding member and the leading edge of the wheel shroud.

2. The centrifugal compressor of claim 1, wherein the slots are angled with respect to a radial direction such that the recirculated air is injected back into the main flow with a swirl component of velocity.

3. The centrifugal compressor of claim 1, wherein there are at least eight said slots distributed over 360° about the wheel shroud.

4. The centrifugal compressor of claim 3, wherein the wheel shroud defines a shroud portion extending circumferentially between each slot and a neighboring slot, and wherein each shroud portion, at the radially outer surface of the wheel shroud, has a greater circumferential extent than does each of the slots.

5. A turbocharger, comprising:

a turbine comprising a turbine wheel mounted in a turbine housing and affixed to one end of a shaft that is rotatable about an axis thereof;

a centrifugal compressor for compressing air to be delivered to an engine air intake, comprising a compressor wheel affixed to an opposite end of the shaft and mounted in a compressor housing, the compressor wheel having a hub defining a rotational axis and having a plurality of circumferentially spaced blades each joined to the hub and extending generally radially outwardly to a blade tip, each of the blades having a leading edge and a trailing edge spaced downstream from the leading edge along a flow direction of a main flow of air through the wheel;

the compressor housing including an inlet duct through which a main flow of air enters in a flow direction generally parallel to the rotational axis of the compressor wheel and is led by the inlet duct into the compressor wheel;

a wheel shroud located radially adjacent the blade tips, the wheel shroud extending upstream from the blades with respect to the main flow proceeding along the flow direction and terminating at a leading edge of the wheel shroud spaced axially upstream of the blade leading edges, the wheel shroud having a radially inner surface wetted by the main flow and having a radially outer surface spaced radially inward of an inner surface of the inlet duct such that an annular space is defined between the radially outer surface of the wheel shroud and the inner surface of the inlet duct;

the wheel shroud defining a port proximate the blade tips and extending generally radially outwardly from the radially inner surface to the radially outer surface of the wheel shroud, into the annular space;

a plurality of circumferentially spaced slots formed in the wheel shroud, each slot extending through the leading edge of the wheel shroud such that the slot is open at the leading edge of the wheel shroud, and extending axially downstream to a position axially spaced from the port in the wheel shroud, and each slot over an entire length thereof extending from the radially inner surface to the radially outer surface of the wheel shroud, such that a portion of air passing through the compressor wheel can flow out through the port into the annular space, then upstream within the annular space, and finally inwardly through the slots so as to be injected, as recirculated air, back into the main flow; and an annular flow-guiding member that extends from the inlet duct radially inwardly and axially downstream to a trailing edge of the flow-guiding member, said trailing edge being proximate the leading edge of the wheel shroud, the flow-guiding member serving to substantially prevent the main flow of air from passing through the slots while allowing the recirculated air to pass through the slots, wherein the trailing edge of the flow-guiding member is axially spaced upstream from the leading edge of the wheel shroud, such that there is a 360-degree gap between the trailing edge of the flow-guiding member and the leading edge of the wheel shroud.

6. The turbocharger compressor of claim 5, wherein the slots are angled with respect to a radial direction such that the recirculated air is injected back into the main flow with a swirl component of velocity.

7. The turbocharger of claim 5, wherein there are at least eight said slots distributed over 360° about the wheel shroud.

8. The turbocharger of claim 7, wherein the wheel shroud defines a shroud portion extending circumferentially between each slot and a neighboring slot, and wherein each shroud portion, at the radially outer surface of the wheel shroud, has a greater circumferential extent than does each of the slots.

* * * * *